US007862150B2

(12) United States Patent
Lee et al.

(10) Patent No.: US 7,862,150 B2
(45) Date of Patent: Jan. 4, 2011

(54) INKHEAD PRINTHEAD CONFIGURED TO OVERCOME IMPAIRED PRINT QUALITY DUE TO NOZZLE BLOCKAGE, PRINTING METHOD USING THE SAME, AND METHOD OF MANUFACTURING THE INKJET PRINTHEAD

(75) Inventors: Moon-chul Lee, Yongin-si (KR); Myong-jong Kwon, Suwon-si (KR); Yong-seop Yoon, Seoul (KR); Jin-wook Lee, Seoul (KR); Yong-won Jeong, Seoul (KR); Donk-sik Shim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 602 days.

(21) Appl. No.: 11/859,885

(22) Filed: Sep. 24, 2007

(65) Prior Publication Data

US 2008/0231665 A1 Sep. 25, 2008

(30) Foreign Application Priority Data

Mar. 23, 2007 (KR) ..... 10-2007-0028863

(51) Int. Cl.
*B41J 2/14* (2006.01)
*B41J 2/16* (2006.01)

(52) U.S. Cl. ..... 347/47; 347/63; 347/65

(58) Field of Classification Search ..... 347/14, 347/19, 40–44, 47, 56, 61–65, 67
See application file for complete search history.

(56) References Cited

U.S. PATENT DOCUMENTS

| | | | | |
|---|---|---|---|---|
| 5,984,455 | A * | 11/1999 | Anderson | 347/47 |
| 6,024,440 | A * | 2/2000 | Murthy et al. | 347/65 |
| 6,267,468 | B1 * | 7/2001 | Torgerson et al. | 347/43 |
| 6,886,921 | B2 * | 5/2005 | Cornell | 347/62 |
| 2006/0103693 | A1 | 5/2006 | Min et al. | |
| 2006/0274111 | A1 | 12/2006 | Cho | |

FOREIGN PATENT DOCUMENTS

| | | |
|---|---|---|
| JP | 2004-50734 | 2/2004 |
| JP | 2006-15735 | 1/2006 |

OTHER PUBLICATIONS

Korean Office Action dated Aug. 14, 2008 issued in KR 2007-28863.

* cited by examiner

*Primary Examiner*—Juanita D Stephens
(74) *Attorney, Agent, or Firm*—Stanzione & Kim LLP

(57) ABSTRACT

The inkjet printhead includes substrate having an ink feed hole formed to supply ink, a chamber layer stacked on the substrate, and including a plurality of main ink chambers formed therein with the ink feed hole therebetween and a plurality of compensation ink chambers formed therein between the main ink chambers that face each other; and a nozzle layer stacked on the chamber layer, and including a plurality of main nozzles corresponding to the main ink chambers and a plurality of compensation nozzles corresponding to the compensation ink chambers.

19 Claims, 13 Drawing Sheets

INKHEAD PRINTHEAD CONFIGURED TO OVERCOME IMPAIRED PRINT QUALITY DUE TO NOZZLE BLOCKAGE, PRINTING METHOD USING THE SAME, AND METHOD OF MANUFACTURING THE INKJET PRINTHEAD

CROSS-REFERENCE TO RELATED APPLICATIONS

This application claims priority under 35 U.S.C. §119(a) from Korean Patent Application No. 10-2007-0028863, filed on Mar. 23, 2007, in the Korean Intellectual Property Office, the disclosure of which is incorporated herein in its entirety by reference.

BACKGROUND OF THE INVENTION

1. Field of the Invention

The present general inventive concept relates to an inkjet printhead, and more particularly, to a thermal inkjet printhead having a good print quality, a printing method using the same, and a method of manufacturing the inkjet printhead.

2. Description of the Related Art

In general, inkjet printers are devices used to form predetermined color images by ejecting minute ink droplets from an inkjet printhead to desired positions on a print medium. Inkjet printers are classified into a shuttle type inkjet printer whose inkjet printhead prints an image while reciprocating in a direction perpendicular to a print medium delivery direction, and a line printing type inkjet printer having a page-wide array printhead corresponding to a width of a print medium. The latter has recently been developed to achieve high-speed printing. The page-wide array printhead has a plurality of inkjet printheads arranged in a predetermined configuration. In the line printing type inkjet printer, during printing, the array printhead is fixed and only a print medium is transported, thereby enabling high-speed printing.

Inkjet printheds may be categorized into two types according to the ink droplet ejection mechanism thereof. The first one is a thermal inkjet printhead in which a heat source is used to generate and expand bubbles in ink, thereby ejecting ink droplets due to an expansion force of the bubbles. The other one is a piezoelectric inkjet printhead in which a piezoelectric body is deformed to exert pressure onto ink, thereby ejecting ink droplets.

An ink droplet ejection mechanism of a thermal inkjet printhead will now be explained in detail. When a pulse current is supplied to a heater including a heating resistor, the heater generates heat and ink near the heater is instantaneously heated up to approximately 300° C., thereby boiling the ink. Accordingly, ink bubbles are generated by ink evaporation, and the generated bubbles are expanded to exert pressure on the ink filled in an ink chamber. As a result, ink around a nozzle is ejected from the ink chamber in a form of droplets through the nozzle.

FIG. 1 is a cross-sectional view of a conventional thermal inkjet printhead. Referring to FIG. 1, the conventional thermal inkjet printhead includes a substrate 10 on which a plurality of material layers are formed, a chamber layer 20 stacked on the substrate 10, and a nozzle layer 30 stacked on the chamber layer 20. A plurality of ink chambers 22 filled with ink to be ejected are formed in the chamber layer 20. Nozzles 32 through which ink is ejected are formed in the nozzle layer 30. The substrate 10 has an ink feed hole 11 formed therethrough to supply ink to the ink chambers 22.

An insulating layer 12 is formed on a top surface of the substrate 10 to insulate the substrate 10 from a plurality of heaters 14. The plurality of heaters 14 are formed on a top surface of the insulating layer to heat the ink in the ink chambers 22 and generate bubbles. Electrodes 16 are formed on top surfaces of the heaters 14 to apply current to the heaters 14. A passivation layer 18 is formed on surfaces of the heaters 14 and the electrodes 16 to protect the heaters 14 and the electrodes 16. Anti-cavitation layers 19 are formed on the passivation layer 18 to protect the heaters 14 from a cavitation force generated when the bubbles collapse.

When there is a dead nozzle that leads to poor ink ejection, shuttle type inkjet printers can compensate for the dead nozzle since an inkjet printhead reciprocates from side to side, thereby preventing print quality degradation. However, line printing type inkjet printers including an array printhead wherein a plurality of inkjet printheads are arranged in a predetermined configuration are difficult to compensate for the dead nozzle since the array printhead is fixed during printing, thereby increasing the risk of impairing print quality.

SUMMARY OF THE INVENTION

The present general inventive concept provides a thermal inkjet printhead with good print quality, a printing method using the same, and a method of manufacturing the inkjet printhead.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an inkjet printhead including a substrate having an ink feed hole formed to supply ink, a chamber layer stacked on the substrate, and including a plurality of main ink chambers formed therein with the ink feed hole therebetween and a plurality of compensation ink chambers formed therein between the main ink chambers that face each other, and a nozzle layer stacked on the chamber layer, and including a plurality of main nozzles corresponding to the main ink chambers and a plurality of compensation nozzles corresponding to the compensation ink chambers.

The compensation nozzles may be arranged in one or more rows in a direction parallel to a longitudinal direction of the ink feed hole. The compensation nozzles may be arranged in two rows and correspond to the main nozzles in a one-to-one fashion.

Each of the main nozzles formed on a side of the chamber layer may be disposed between adjacent main nozzles of the main nozzles formed on an other side of the chamber layer in the longitudinal direction of the ink feed hole. The compensation nozzles may be arranged on same lines as corresponding main nozzles in a direction perpendicular to the longitudinal direction of the ink feed hole. The compensation nozzles may deviate from the corresponding main nozzles in the longitudinal direction of the ink feed hole.

The chamber layer may have a plurality of through-holes through which ink is supplied from the ink feed hole to the main ink chambers and the compensation ink chambers. The chamber layer may have bridges formed between the through-holes to connect a portion of the chamber layer in which the main chambers are formed and a portion of the chamber layer in which the compensation ink chambers are formed. The bridges may be formed at a same height as the chamber layer.

The main chambers may be formed under the main nozzles, and the compensation ink chambers may be formed under the compensation nozzles.

The inkjet printhead may further include an insulating layer formed on a top surface of the substrate. The inkjet printhead may further include main heaters and compensation heaters formed on a top surface of the insulting layer to correspond to the main ink chambers and the compensation ink chambers, respectively, and main electrodes and compensation electrodes formed on top surfaces of the main heaters and the compensation heaters.

The inkjet printhead may further include a passivation layer formed on the insulating layer to cover the main heaters, the compensation heaters, the main electrodes, and the compensation electrodes. The inkjet printhead may further include anti-cavitation layers formed on a top surface of the passivation layer above the main heaters and the compensation heaters.

The foregoing and/or other aspects and utilities of the general inventive concept may also be achieved by providing a printing method of an inkjet printhead, the printing method including ejecting ink from leading main nozzles formed on one side of a chamber layer in a print direction, ejecting ink from compensation nozzles, and ejecting ink from trailing main nozzles formed on an other side of the chamber layer in the print direction.

The foregoing and/or other aspects and utilities of the general inventive concept may also be achieved by providing a method of manufacturing an inkjet printhead, the method including forming an insulating layer on a substrate, forming a plurality of main heaters and a plurality of compensation heaters on the insulating layer, forming main electrodes and compensation electrodes on the main heaters and the compensation heaters, respectively, forming trenches of predetermined shapes in the insulating layer between the main heaters and the compensation heaters to expose a top surface of the substrate, forming on the insulating layer a chamber layer in which main ink chambers and compensation ink chambers are formed, forming on the chamber layer a nozzle layer in which main nozzles and compensation nozzles are formed, and forming an ink feed hole in the substrate.

The forming of the nozzle layer may include forming a sacrificial layer filled in the main ink chambers, the compensation ink chambers, the trenches, and the through-holes, forming a nozzle material layer on the sacrificial layer and the chamber layer, and patterning the nozzle material layer and forming the main nozzles and compensation nozzles.

The method may further include planarizing a top surface of the sacrificial layer, after the forming of the sacrificial layer.

The ink feed hole may be formed by etching a bottom surface of the substrate until a bottom surface of the sacrificial layer filled in the trenches is exposed. After the forming of the ink feed hole, the method may further include removing the sacrificial layer filled in the main ink chambers, the compensation ink chambers, the through-holes, and the trenches.

The foregoing and/or other aspects and utilities of the general inventive concept may also be achieved by providing an inkjet printhead, including a chamber layer having one or more ink chambers to store ink, and a nozzle layer stacked on the chamber layer having one or more rows of main nozzles and one or more rows of compensation nozzles to discharge the ink, wherein the compensation nozzles correspond to the main nozzles, respectively.

The foregoing and/or other aspects and utilities of the general inventive concept may also be achieved by providing a printing method of an inkjet print head, the method including ejecting ink from one or more rows of main nozzles arranged in a traverse direction to a printing direction, and ejecting ink from one or more rows of compensation nozzles arranged in the traverse direction to the printing direction and corresponding to the main nozzles, respectively.

The foregoing and/or other aspects and utilities of the general inventive concept may also be achieved by providing a method of manufacturing an inkjet printhead, the method including forming a chamber layer, and forming a nozzle layer on the chamber layer having one or more rows of main nozzles arranged in a traverse direction to a printing direction and one or more rows of compensation nozzles arranged in the traverse direction to the printing direction in which the compensation nozzles correspond to the main nozzles, respectively.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
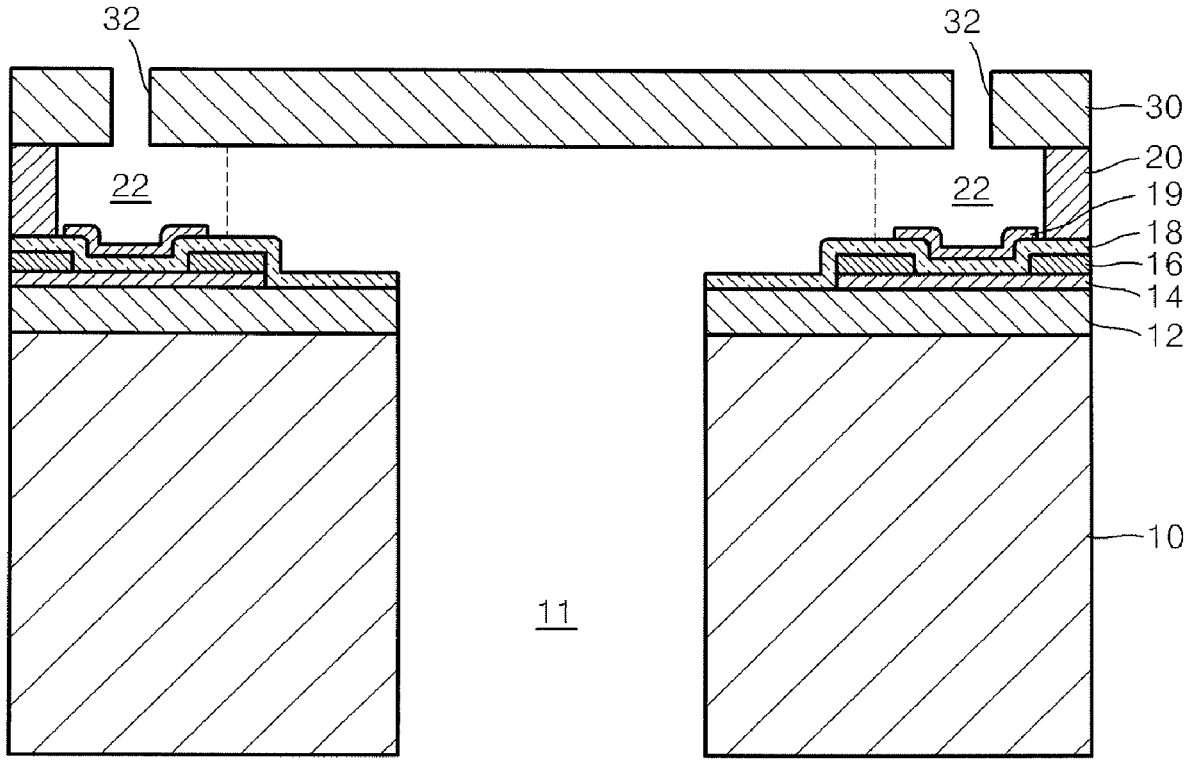
FIG. 1 (PRIOR ART)
FIG. 1 is a cross-sectional view illustrating a conventional inkjet printhead.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

The general inventive concept may, however, be embodied in different forms and should not be construed as limited to the embodiments set forth herein. For example, it will also be understood that when a layer is referred to as being "on" a substrate or another layer, it may be directly on the substrate or the other layer, or a third layer may also exist therebetween. Each element of an inkjet printhead may be formed of a different material from the illustrated one. Furthermore, in a method of forming an inkjet printhead, operations of the method may be performed in a different order from the illustrated order.

Figure 2:
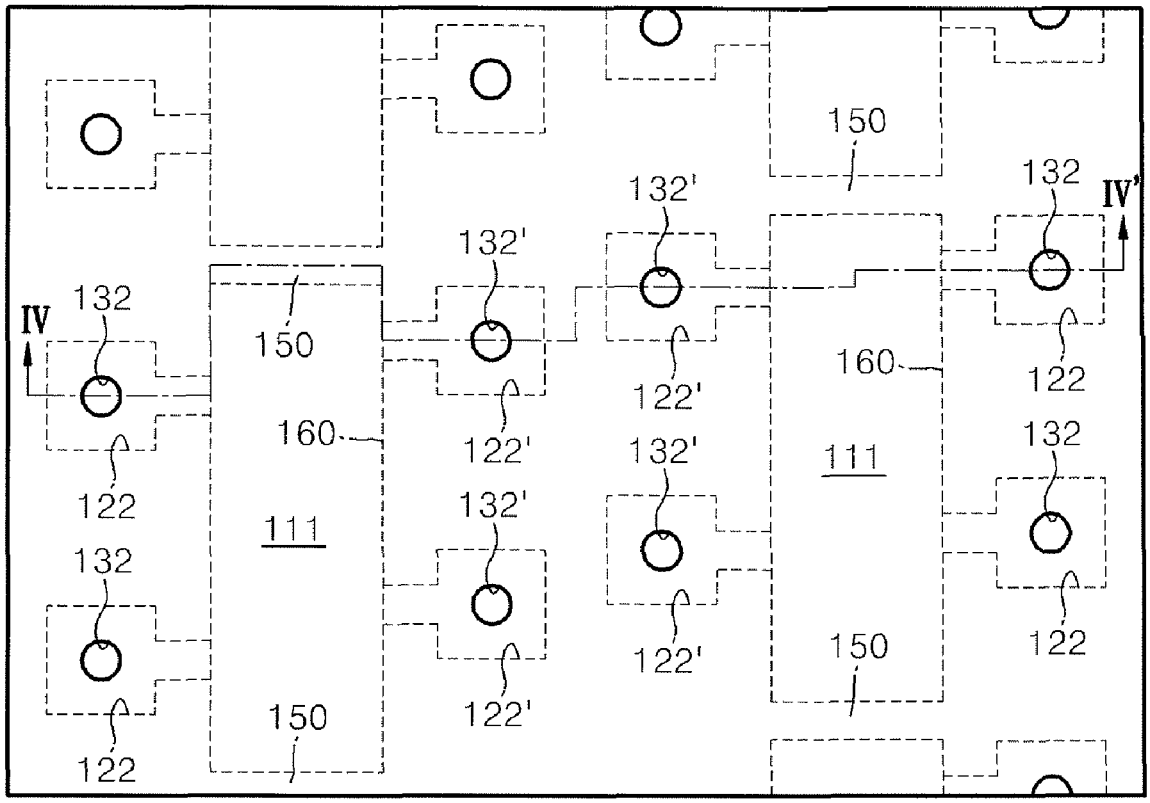
FIG. 2 is a plan view illustrating an inkjet printhead according to an embodiment of the present general inventive concept.
Figure 3:
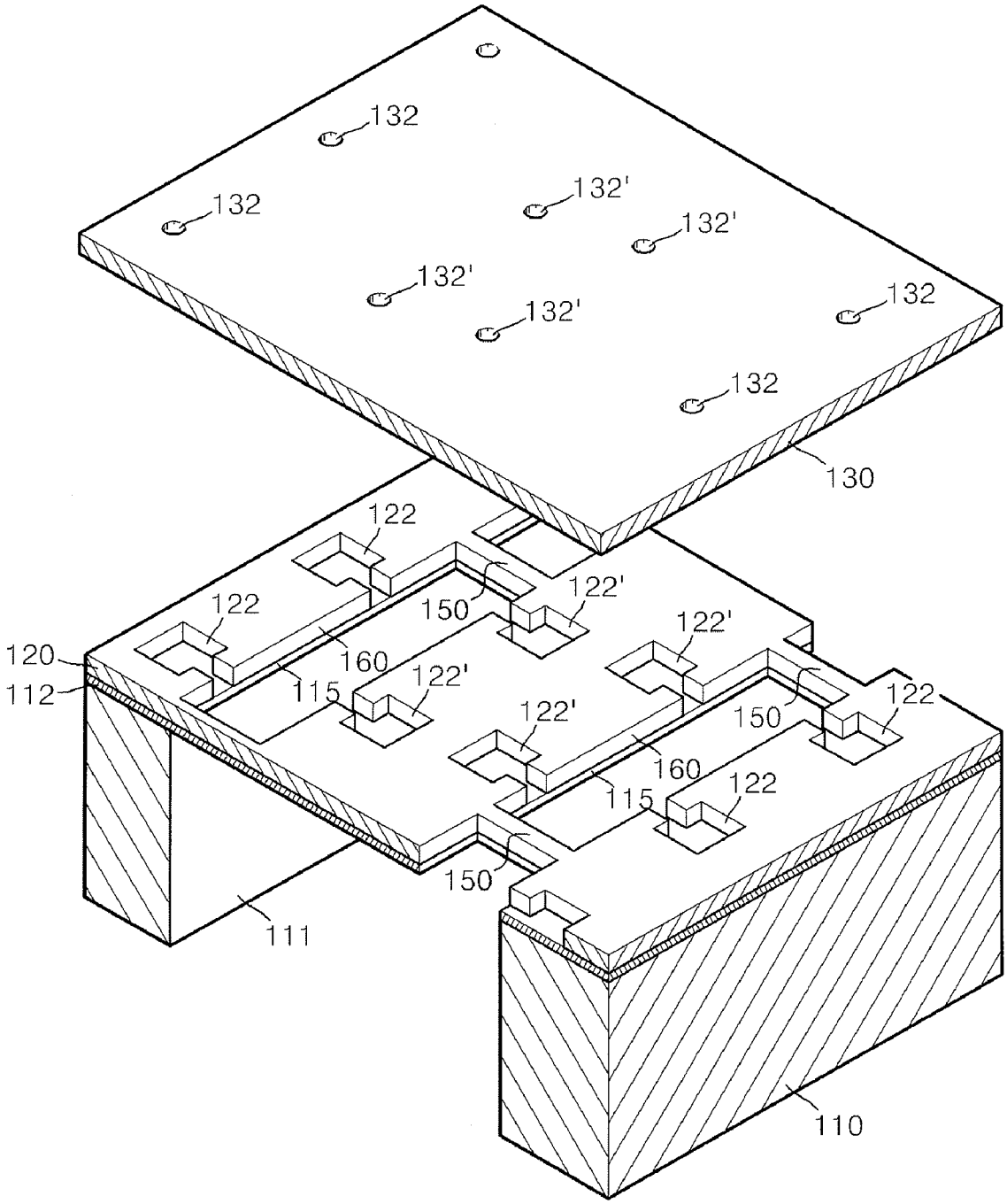
FIG. 3 is an exploded perspective view illustrating the inkjet printhead of FIG. 2.
Figure 4:
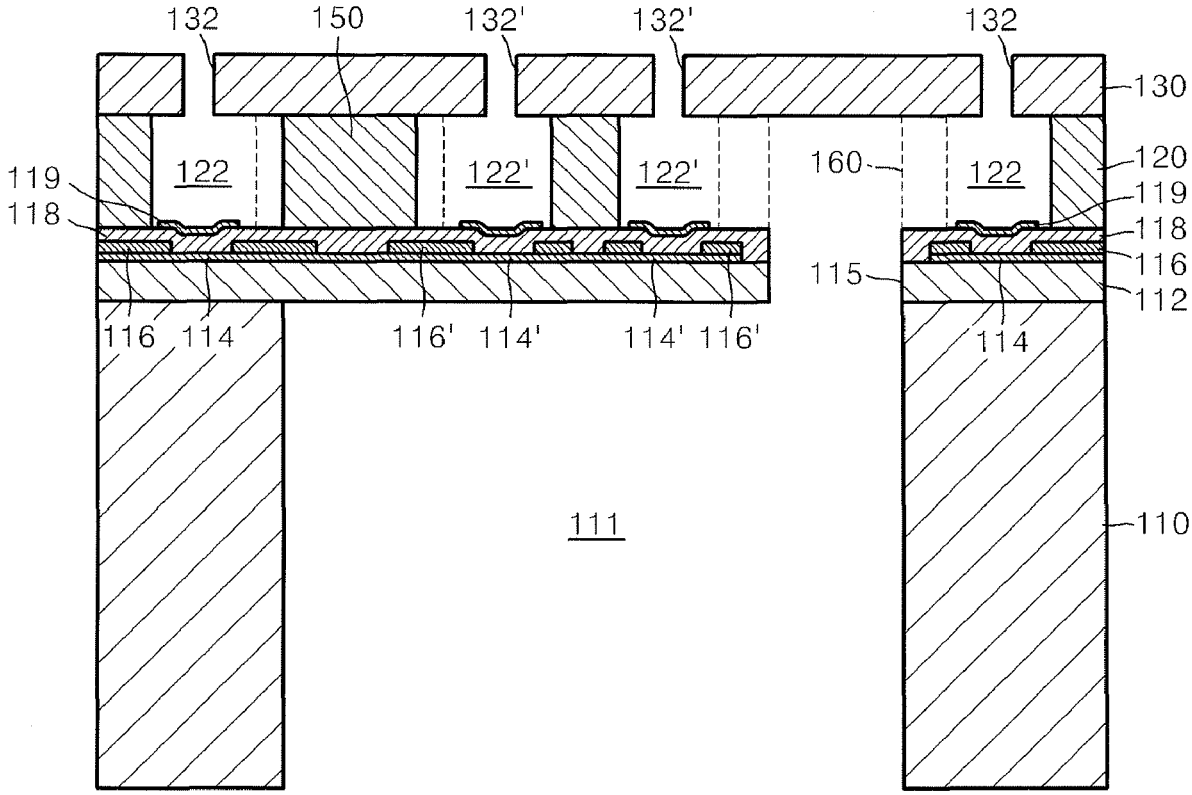
FIG. 4 is a cross-sectional view taken along line IV-IV' of FIG. 2.

FIG. 2 is a plan view illustrating a thermal inkjet printhead according to an embodiment of the present general inventive concept. FIG. 3 is an exploded perspective view illustrating the inkjet printhead of FIG. 2. FIG. 4 is a cross-sectional view taken along line IV-IV' of FIG. 2.

Referring to FIGS. 2 through 4, the inkjet printhead includes a substrate 110 on which a plurality of material layers are formed, a chamber layer 120 stacked on the substrate 110, and a nozzle layer 130 stacked on the chamber layer 120. The substrate 110 is generally a silicon substrate. An ink feed hole 111 is formed in the substrate 110 to supply ink. The ink feed hole 111 may be formed through the substrate 110 in a direction perpendicular to a surface of the substrate 110.

A plurality of main ink chambers 122 and a plurality of compensation ink chambers 122' filled with the ink supplied from the ink feed hole 111 are formed in the chamber layer 120. The main ink chambers 122 may be formed in both sides of the chamber layer 120 with the ink feed hole 111 therebetween, and the compensation ink chambers 122' may be formed between the main ink chambers 122 that face each other. The compensation ink chambers 122' may be arranged in two rows in a longitudinal direction of the ink feed hole 111, and correspond to the main ink chambers 122 in a one-to-one fashion.

Each of the main ink chambers 122 formed in a side of the chamber layer 120 may be disposed between adjacent main ink chambers of the main ink chambers 122 formed in the other side of the chamber layer 122 in the longitudinal direction of the ink feed hole 111, but the present embodiment is not limited thereto. The compensation ink chambers 122' may deviate from their corresponding main ink chambers 122 in the longitudinal direction of the ink feed hole 111. However, the present embodiment is not limited thereto, and the compensation ink chambers 122' may be arranged on the same lines as their corresponding main ink chambers 122 in the direction perpendicular to the longitudinal direction of the ink feed hole 111.

Through-holes 160 through which ink is supplied from the ink feed hole 111 to the main ink chambers 122 and the compensation ink chambers 122' may be formed in the chamber layer 120. In detail, the through-holes 160 may be formed between the main ink chambers 122 and the compensation ink chambers 122' which correspond to each other. A plurality of bridges 150 may be formed between the through-holes 160 to connect a portion of the chamber layer 120 in which the main ink chambers 122 are formed and a portion of the chamber layer 120 in which the compensation ink chambers 122' are formed. The bridges 150 may be formed at a same height as the chamber layer 120.

Referring to FIGS. 2-4, a plurality of main nozzles 132 and a plurality of compensation nozzles 132' through which ink is ejected are formed in the nozzle layer 130. The main nozzles 132 may be formed on the main ink chambers 122, and the compensation nozzles 132' may be formed on the compensation ink chambers 122'. Accordingly, the compensation nozzles 132' may be formed in two rows, and correspond to the main nozzles in a one-to-one fashion. Each of the main nozzles 132 formed on a side of the chamber layer 120 may be disposed between adjacent main nozzles 132 of the main nozzles 132 formed on the other side of the chamber layer 120 in the longitudinal direction of the ink feed hole 111. The compensation nozzles 132' may be deviated from their corresponding main nozzles 132 in the longitudinal direction of the ink feed hole 111. However, the present embodiment is not limited thereto, and the compensation nozzles 132' may be arranged on the same lines as their corresponding main nozzles 132 in the direction perpendicular to the longitudinal direction of the ink feed hole 111.

An insulating layer 112 may also be formed on a top surface of the substrate 110. The insulating layer 112 may be formed of a silicon oxide. Main heaters 114 and compensation heaters 114' are formed on a top surface of the insulating layer 112 to heat ink and generate bubbles. The main heaters 114 are formed below the main ink chambers 122, and the compensation heaters 114' are formed below the compensation ink chambers 122'. Each of the main heaters 114 and the compensation heaters 114' may be formed of a heating resistor such as a tantalum-aluminium alloy, a tantalum nitride, a titanium nitride, or a tungsten silicide. Main electrodes 116 are formed on top surfaces of the main heaters 114, and compensation electrodes 116' are formed on top surfaces of the compensation heaters 114'. Each of the main electrodes 116 and the compensation electrodes 116' may be formed of a metal with high electrical conductivity, such as aluminium (Al), an aluminium alloy, gold (Au), or silver (Ag). The compensation electrodes 116 may be electrically connected by the bridges 150 for the purpose of circuit control.

Referring to FIG. 4, a passivation layer 118 may be further formed on the insulating layer 112 to cover the main heaters 114, the compensation heaters 114', the main electrodes 116, and the compensation electrodes 116'. The passivation layer 118 prevents the main heaters 114, the compensation heaters 114', the main electrodes 116, and the compensation electrodes 116' from being oxidized or corroded due when they contact ink. The passivation layer 118 may be formed of a silicon oxide or a silicon nitride. Trenches 115 are formed through the passivation layer 118 and the insulating layer 112 to connect the ink feed hole 111 and the through-holes 160. Anti-cavitation layers 119 may be further formed on a top surface of the passivation layer 118 above the main heaters 114 and the compensation heaters 114'. The anti-cavitation layers 119 protect the main heaters 114 and the compensation heaters 114' from a cavitation force generated when bubbles collapse. The anti-cavitation layers 119 may be formed of tantalum (Ta).

In the inkjet printhead constructed as described above, ink in the ink feed hole 111 is supplied through the through-holes 160 to the main ink chambers 122 and the compensation ink chambers 122'. When current is applied by the main electrodes 116 and the compensation electrodes 116' to the main heaters 114 and the compensation heaters 114', bubbles are generated and expanded in the main ink chambers 122 and the compensation ink chambers 122', and thus ink is ejected in a form of droplets through the main nozzles 132 and the compensation nozzles 132' due to the expansion force of the bubbles.

While one ink feed hole 111 is formed in the substrate 110 as illustrated in FIGS. 2 through 4, the present embodiment is not limited thereto and a plurality of ink feed holes 111 may be formed in the substrate 110 according to ink colors. While the compensation nozzles 132' are arranged in two rows and correspond to the main nozzles 132 in a one-to-one fashion as illustrated in FIGS. 2 through 4, the present embodiment is not limited thereto, and thus the compensation nozzles 132' may be arranged in one row or three or more rows in various configurations.

A printing method using a conventional inkjet printhead and a printing method using the inkjet printhead of FIGS. 2 through 4 will now be explained. Leading main nozzles and trailing main nozzles arranged in a print direction are assumed such that each of the leading main nozzles is disposed between adjacent trailing main nozzles of the trailing main nozzles in a direction perpendicular to the print direction, that is, in a longitudinal direction of an ink feed hole.

Figure 5A:
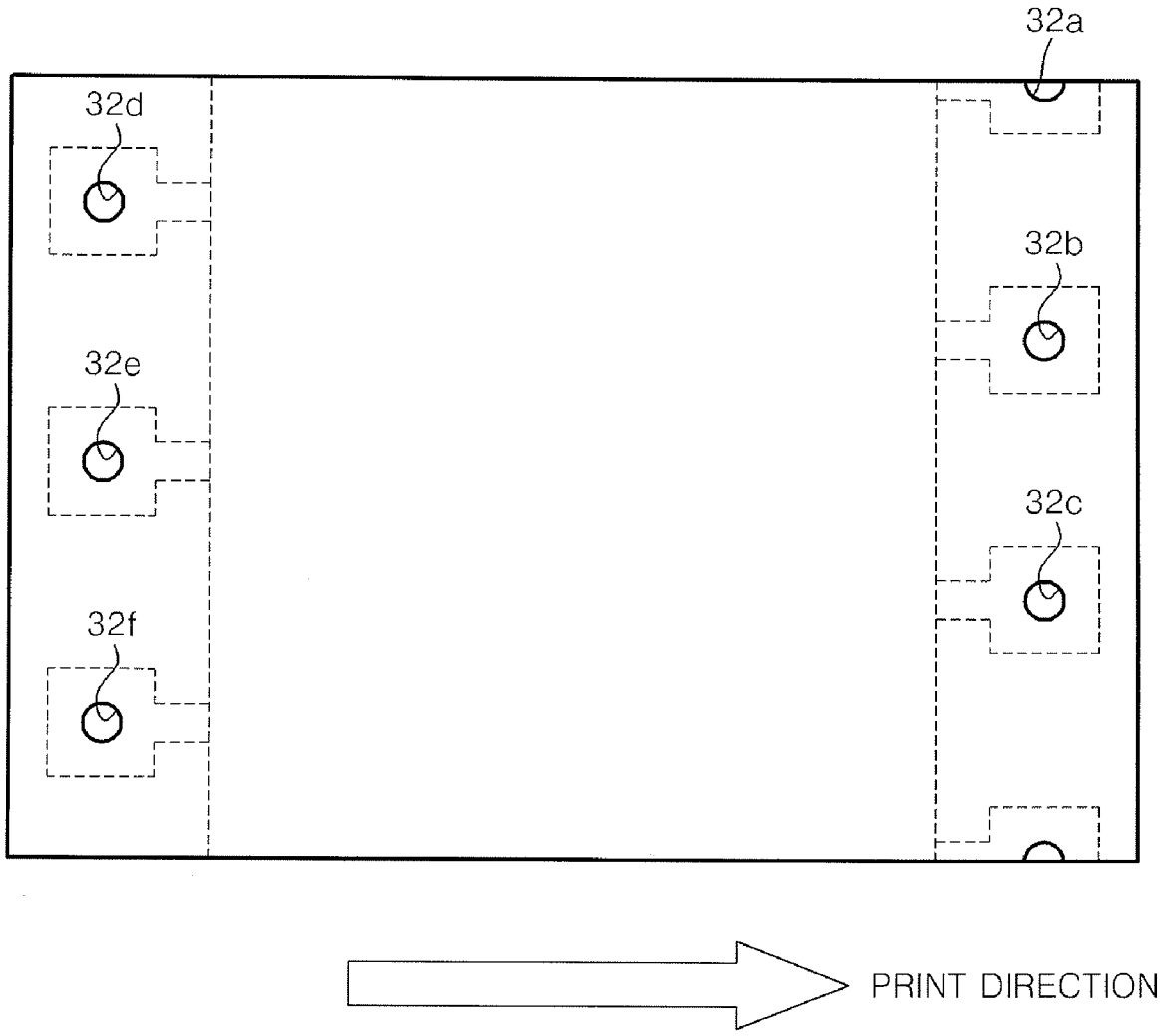
FIGS. 5A and 5B illustrate a print direction and ejected ink droplets of the conventional inkjet printhead of FIG. 1.
Figure 5B:
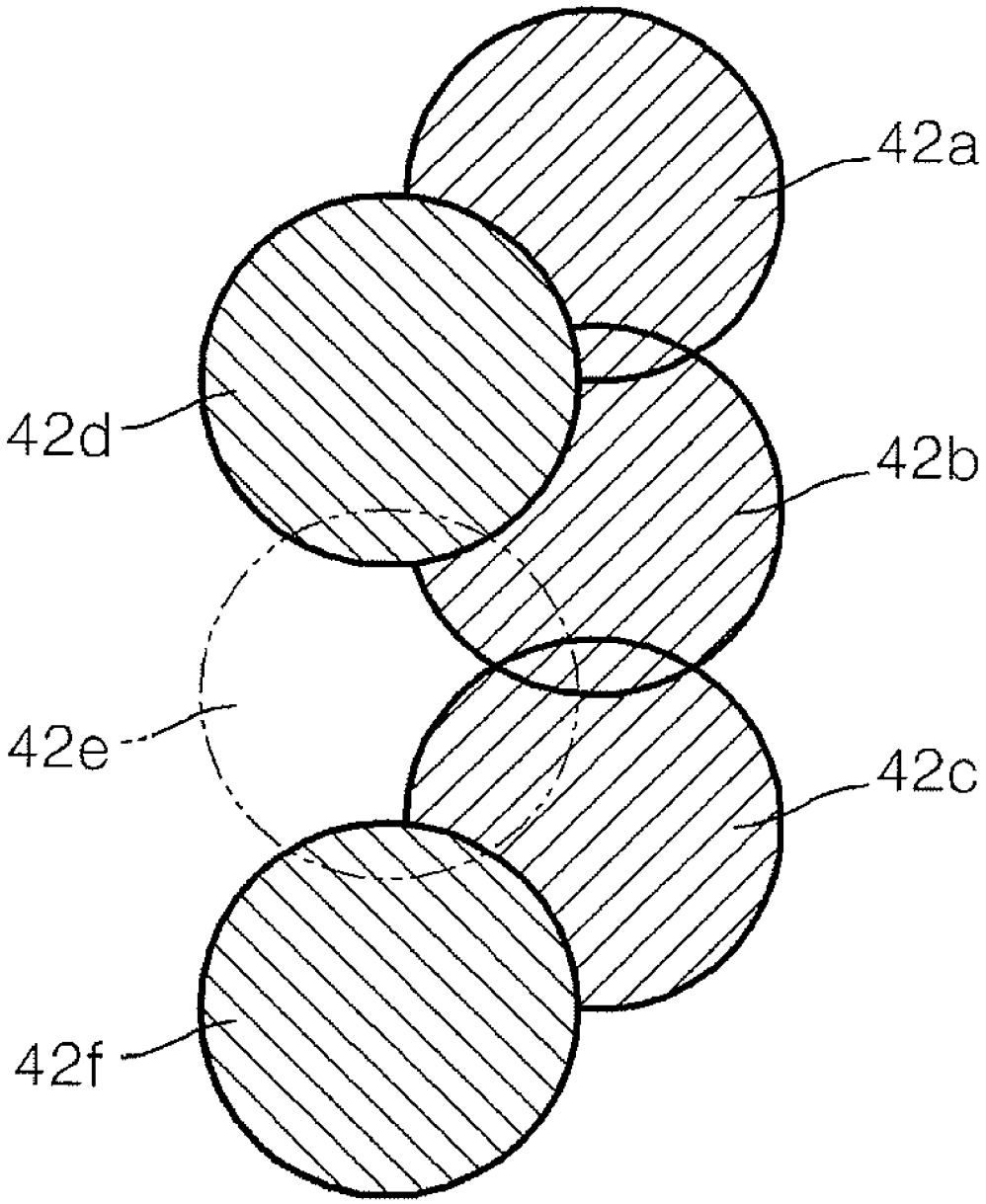

FIG. 5A is a plan view illustrating a print direction of a conventional inkjet printhead of FIG. 1. FIG. 5B illustrates ink droplets ejected and printed on a sheet of paper by the conventional inkjet printhead of FIG. 1. In FIG. 5A, reference numerals 32*a*, 32*b*, and 32*c* denote leading nozzles in a print direction, and reference numerals 32*d*, 32*e*, and 32*f* denote trailing nozzles in the print direction. A dead nozzle, which leads to poor ink ejection, among the nozzles is denoted by reference numeral 32*e*.

Referring to FIGS. 5A and 5B, the conventional inkjet printhead ejects ink droplets onto predetermined positions on a printing medium such as a sheet of paper from the leading nozzles 32*a*, 32*b*, and 32*c*. In FIG. 5B, reference numerals 42*a*, 42*b*, 42*c* denote ink droplets ejected onto the sheet of paper from the leading nozzles 32*a*, 32*b*, and 32*c*. Next, while moving in the print direction, the conventional inkjet printhead ejects ink droplets onto predetermined positions of the sheet of paper from the trailing nozzles 32*d*, 32*e*, and 32*f*. During this process, ink is not ejected or abnormally ejected through the dead nozzle 32*e* that leads to poor ink ejection. In FIG. 5B, reference numerals 42*d* and 42*f* denote ink droplets ejected onto the sheet of paper from the trailing nozzles 32*d* and 32*f*, and reference numeral 42*e* denotes a missing portion of the sheet of paper formed because of the dead nozzle 32*e*. As such, when there is the dead nozzle 32*e*, the conventional inkjet printhead suffers print quality degradation. The problem becomes even more severe with the use of an array printhead that is fixed during printing.

Figure 6A:
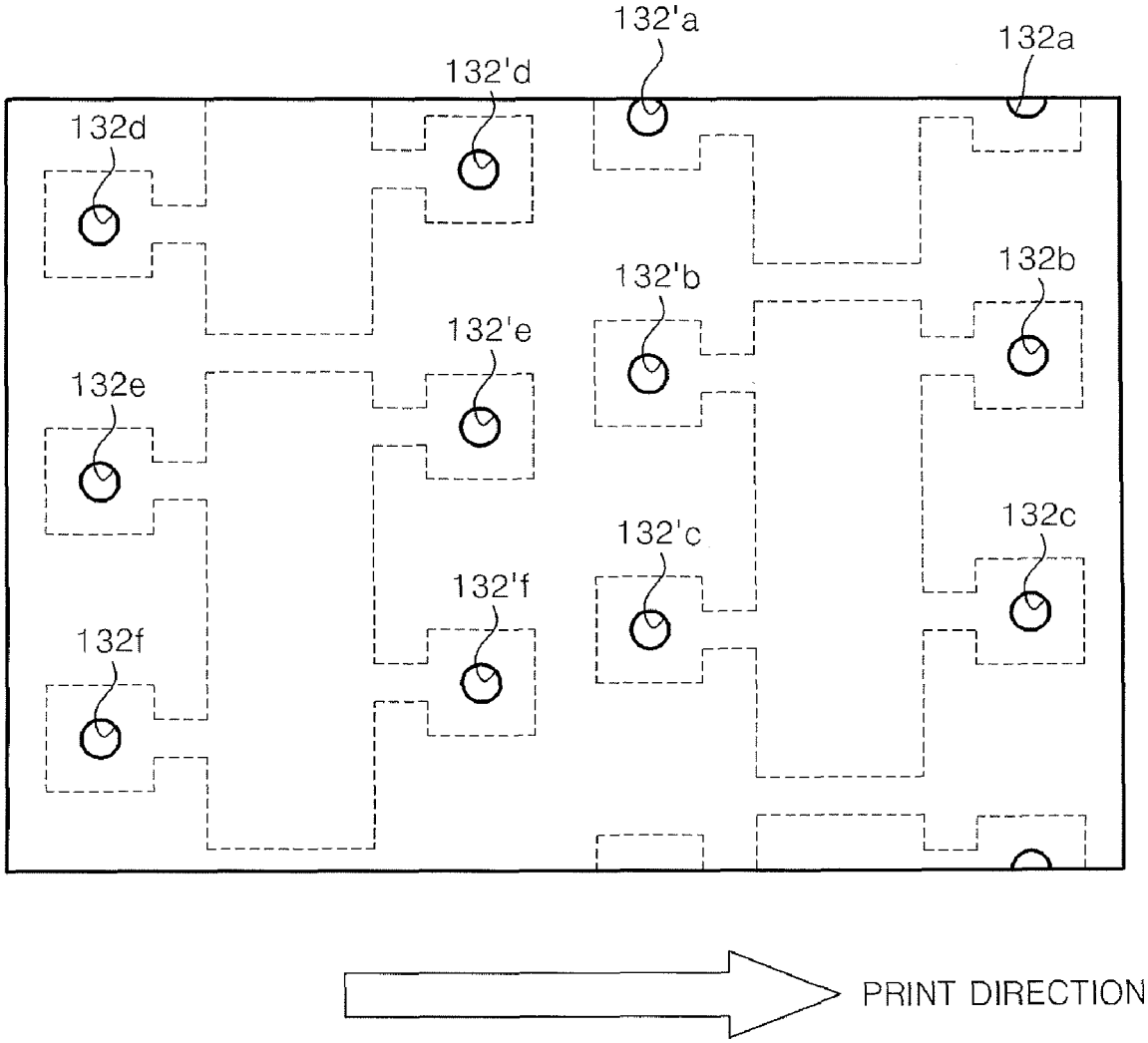
FIGS. 6A and 6B illustrate a print direction and ejected ink droplets of the inkjet printhead of FIGS. 2 through 4.
Figure 6B:
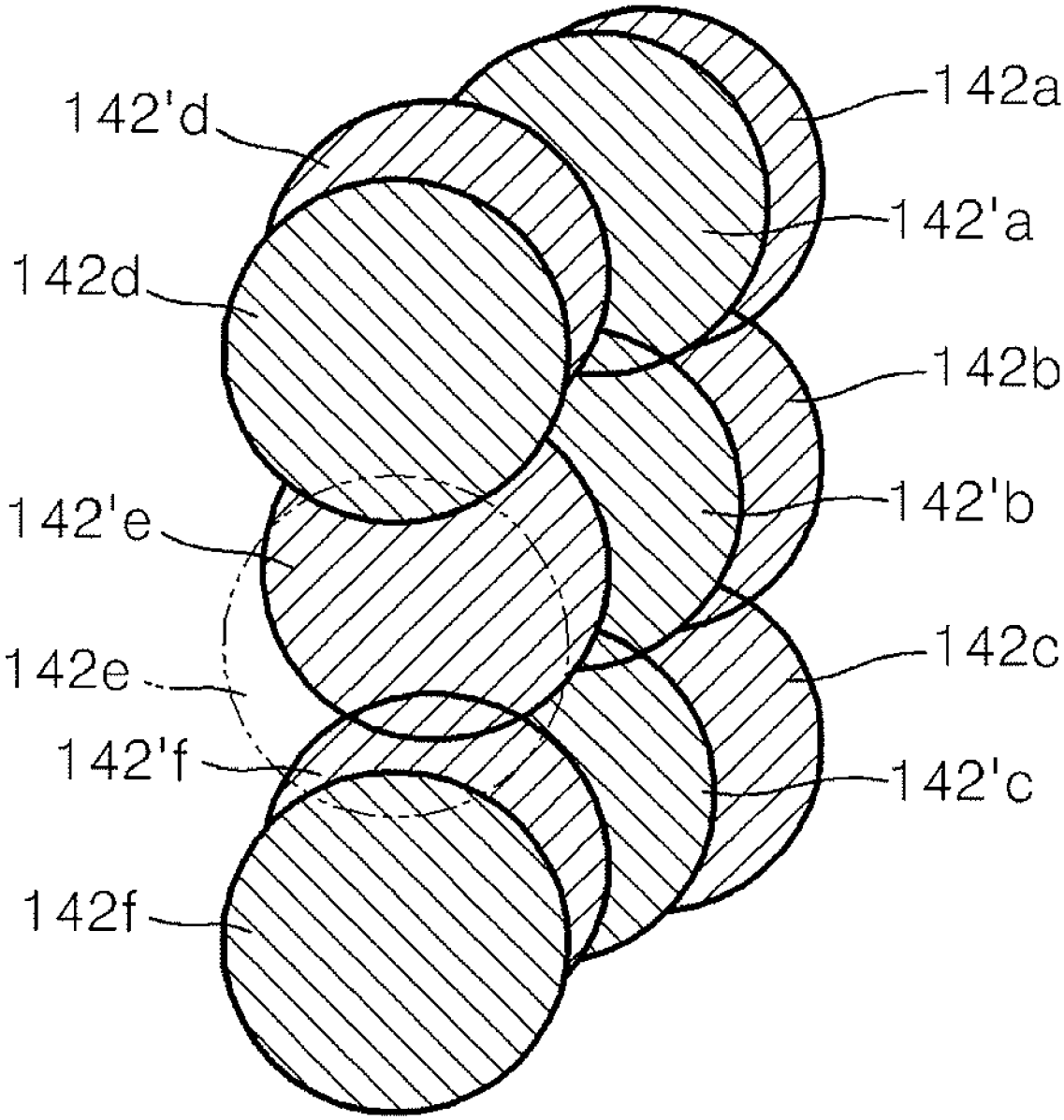

FIG. 6A is a plan view illustrating a print direction of the inkjet printhead of FIGS. 2 through 4. FIG. 6B illustrates ink droplets ejected and printed on a sheet of paper by the inkjet printhead of FIGS. 2 through 4. It is assumed that compensation nozzles are arranged in two rows and correspond to main nozzles in a one-to-one fashion, and the compensation nozzles deviate from their corresponding main nozzles in a print direction, that is, in a direction perpendicular to a longitudinal direction of the ink feed hole 111. For example, leading main nozzles and trailing main nozzles are arranged in a print direction such that each of the leading main nozzles can be disposed between adjacent trailing main nozzles of the trailing main nozzles in the direction perpendicular to the print direction. In FIG. 6A, reference numerals 132*a*, 132*b*, and 132*c* denote leading main nozzles in the print direction, and reference numerals 132*d*, 132*e*, and 132*f* denote trailing main nozzles in the print direction. A dead main nozzle, which leads to poor ink ejection, among the main nozzles is denoted by reference numeral 132*e*. Reference numerals 132'*a*, 132'*b*, and 132'*c* denote leading compensation nozzles in the print direction, and reference numerals 132'*d*, 132'*e*, and 132'*f* denote trailing compensation nozzles in the print direction.

Referring to FIGS. 6A and 6B, the inkjet printhead ejects ink droplets onto predetermined positions of a sheet of paper from the leading main nozzles 132*a*, 132*b*, and 132*c*. The inks droplets may be simultaneously or sequentially ejected from the leading main nozzles 132*a*, 132*b*, and 132*c*. In FIG. 6B, reference numerals 142*a*, 142*b*, and 142*c* denote the ink droplets ejected onto the sheet of paper from the leading main nozzles 132*a*, 132*b*, and 132*c*. Next, while moving in the print direction, the inkjet printhead ejects ink droplets onto predetermined positions of the sheet of paper from the leading compensation nozzles 132'*a*, 132'*b*, and 132'*c* corresponding to the leading main nozzles 132*a*, 132*b*, and 132*c*. The ink droplets may be simultaneously or sequentially ejected from the leading compensation nozzles 132'*a*, 132'*b*, and 132'*c*. In FIG. 6B, reference numerals 142'*a*, 142'*b*, and 142'*c* denote the ink droplets ejected onto the sheet of paper from the leading compensation nozzles 132'*a*, 132'*b*, and 132'*c*. Next, while moving in the print direction, the inkjet printhead ejects ink droplets to predetermined positions of the sheet of paper from the trailing compensation nozzles 132'*d*, 132'*e*, and 132'*f* corresponding to the trailing main nozzles 132*d*, 132*e*, and 132*f*. The ink droplets may be simultaneously or sequentially ejected from the trailing compensation nozzles 132'*d*, 132'*e*, and 132'*f*. In FIG. 6B, reference numerals 142'*d*, 142'*e*, and 142'*f* denote the ink droplets ejected onto the sheet of paper from the trailing compensation nozzles 132'*d*, 132'*e*, and 132'*f*. While moving in the print direction, the inkjet printhead ejects ink droplets onto predetermined positions of the sheet of paper from the trailing main nozzles 132*d*, 132*e*, and 132*f*. The ink droplets may be simultaneously or sequentially ejected from the trailing main nozzles 132*d*, 132*e*, and 132*f*. During this process, ink is not ejected or abnormally ejected through the dead main nozzle 132*e* that leads to poor ink ejection. In FIG. 6B, reference numerals 142*d* and 142*f* denote the ink droplets ejected onto the sheet of paper from the trailing main nozzles 132*d* and 132*f*, and reference numeral 142*e* denotes a missing portion of the sheet of paper formed because of the dead main nozzle 132*e*. When a printing operation is performed using the inkjet printhead, the missing portion 142*e* of ink on the sheet of paper, that would otherwise have been completely filled by ink discharged from the dead main nozzle 132*e*, is almost fully filled with the ink droplet 142'*e* ejected onto the sheet of paper from the trailing compensation nozzle 132'*e* corresponding to the dead main nozzle 132*e*, and is partially filled with the ink droplet 142'*f* ejected onto the sheet of paper from the trailing compensation nozzle 132'*f* adjacent to the compensation nozzle 132*e* as well.

Accordingly, even when there is the dead main nozzle 132*e*, which leads to poor ink ejection, in the inkjet printhead, the compensation nozzles 132'*e* and the compensation nozzle 132'*f* compensate for the dead main nozzle 132*e*, thereby improving print quality.

While the main nozzle 132*e* is inoperative and is compensated for by the compensation nozzles 132'*e* and 132*ef* in the above, the present embodiment is not limited thereto and a compensation nozzle may be inoperative and may be compensated for by main nozzles. Also, the printing method using the inkjet printhead according to the present embodiment is exemplary, and various other printing methods may be realized.

The inkjet printhead according to the present embodiment is particularly useful for a line printing type inkjet printer using a page-wide array printhead corresponding to the width of a print medium. The array printhead has a plurality of inkjet printheads, each of which is constructed as described above, arranged in a predetermined configuration. Since an array printhead of a line printing type inkjet printer is fixed during printing, when there is a dead nozzle, the line printing type inkjet printer tends to suffer print quality degradation. However, the inkjet array printhead according to the present embodiment can prevent such print quality degradation using the compensation nozzles that can compensate for the dead nozzle. The inkjet printhead according to the present embodiment can also be applied to a shuttle type inkjet printer whose inkjet printhead prints an image while reciprocating in a direction perpendicular to a print medium delivery direction.

A method of manufacturing an inkjet printhead according to an embodiment of the present general inventive concept will now be explained with reference to FIGS. 7 through 13.

Figure 7:
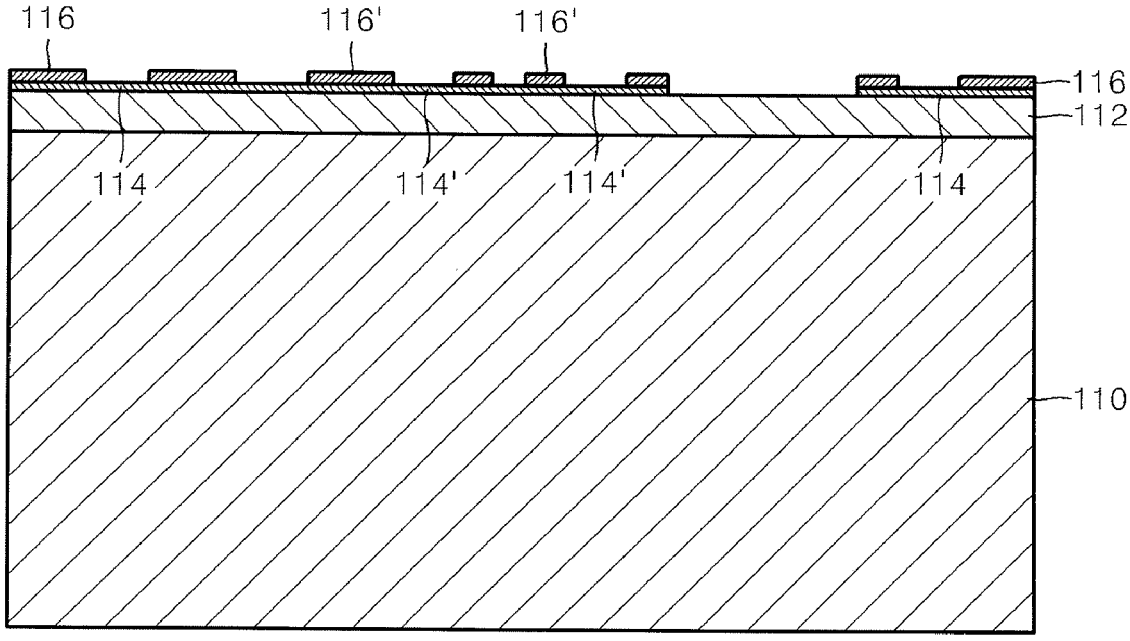
FIGS. 7 through 13 are cross-sectional views illustrating a method of manufacturing an inkjet printhead according to an embodiment of the present general inventive concept.

Referring to FIG. 7, a substrate 110 is prepared. The substrate 110 is generally a silicon substrate. An insulating layer 112 is formed on a top surface of the substrate 110. The insulating layer 112 insulates the substrate 110 from main heaters 114 and compensation heaters 114' formed on the insulating layer 112. The insulating layer 112 may be formed of a silicon oxide. The plurality of main heaters 114 and the plurality of compensation heaters 114' are formed on a top surface of the insulating layer 112 to heat ink and generate bubbles. The main heaters 114 may be formed below main ink chambers 122 (FIG. 9) as will be described later, and the compensation heaters 114' may be formed below the compensation ink chambers 122' (FIG. 9) as will be described later. The main heaters 114 and the compensation heaters 114' may be formed by depositing a heating resistor, such as a tantalum-aluminium alloy, a tantalum nitride, a titanium nitride, or a tungsten silicide, on a top surface of the insulating layer 112, and then patterning the heating resistor into a predetermined shape. Next, main electrodes 116 and compensation electrodes 116' are formed on top surfaces of the main heaters 114 and the compensation heaters 114', respectively. The main electrodes 116 and the compensation electrodes 116' may be formed by depositing a metal with high electrical conductivity, such as aluminium (Al), an aluminium alloy, gold (Au), or silver (Ag), on top surfaces of the main heaters 114 and the compensation heaters 114' and then patterning the metal.

Figure 8:
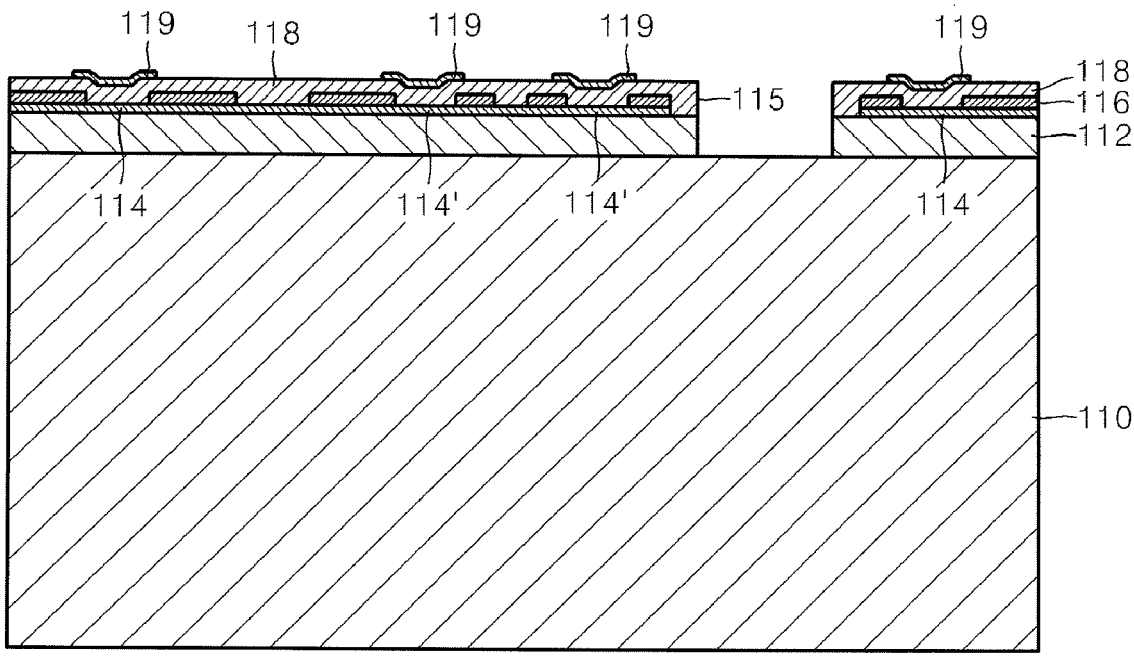

Referring to FIG. 8, a passiviation layer 118 may be further formed on the insulating layer 112 to cover the main heaters 114, the compensation heaters 114', the main electrodes 116, and the compensation electrodes 116'. The passivation layer 118 prevents the main heaters 114, the compensation heaters 114', the main electrodes 116, and the compensation electrodes 116' from being oxidized or corroded when they contact ink. The passivation layer 118 may be formed of a silicon oxide or a silicon nitride. Anti-cavitation layers 119 may be further formed on a top surface of the passivation layer 118 above the main heaters 114 and the compensation heaters 114'. The anti-cavitation layers 119 protect the main heaters 114 and the compensation heaters 114' from a cavitation force generated when bubbles collapse. The anti-cavitation layers 119 may be formed of tantalum (Ta). Next, the passivation layer 118 and the insulating layer 112 are sequentially etched to form trenches 115 of predetermined shapes until the trenches 115 expose a top surface of the substrate 110. The trenches 115 may be formed between the main heaters 114 and the compensation heaters 114'. The trenches 115 connect an ink feed hole 111 (FIG. 13) and through-holes 160 (FIG. 13) in a subsequent process.

Figure 9:
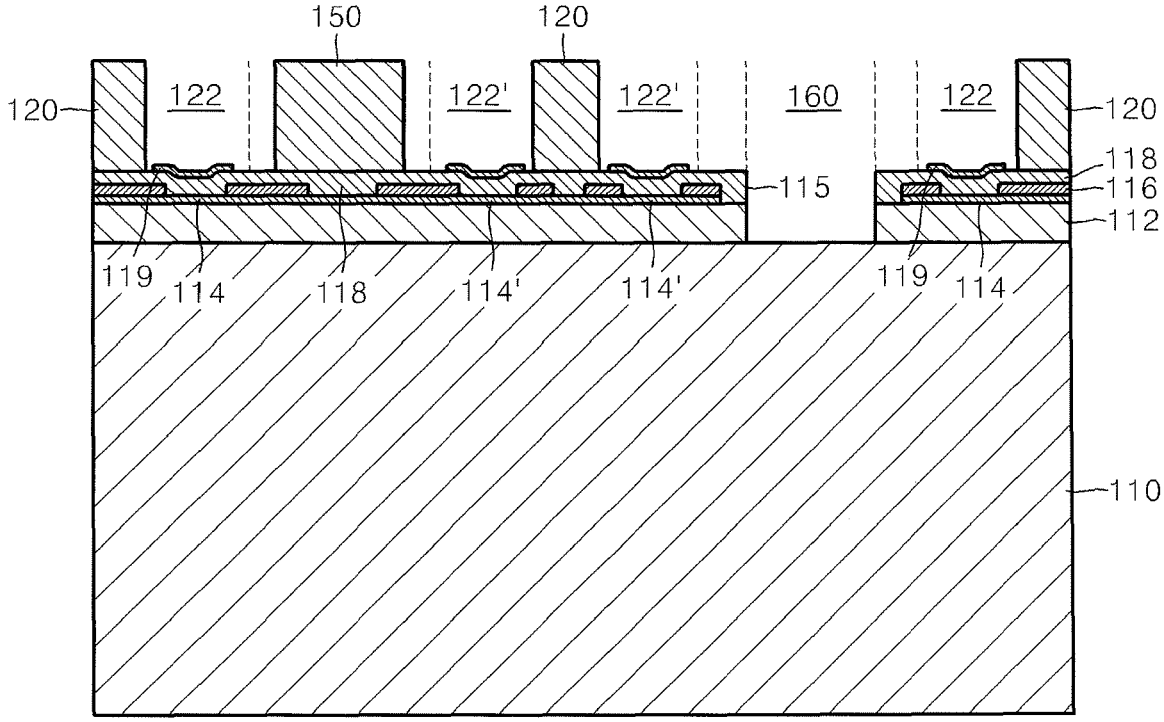

Referring to FIG. 9, a chamber layer 120 is formed on the passivation layer 118. In detail, the chamber layer 120 may be formed by depositing a chamber material layer (not illustrated) to a predetermined thickness to cover the resulting structure of FIG. 8, and then patterning the chamber material layer. The chamber layer 120 may be formed of epoxy, but the present embodiment is not limited thereto. In this process, a plurality of main ink chambers 122 and a plurality of compensation ink chambers 122' filled with ink supplied from the ink feed hole 111 (FIG. 13) are formed in the chamber layer 120. The main ink chambers 122 are formed above the main heaters 114, and the compensation ink chambers 122' are formed above the compensation heaters 114'. Accordingly, the main ink chambers 122 are formed in both sides of the chamber layer 120 with the ink feed hole 111 (FIG. 13) therebetween, and the compensation ink chambers 122' are formed between the main ink chambers 122 that face each other.

The through-holes 160 communicating with the trenches 115 are formed between the main ink chambers 122 and the compensation ink chambers 122' (FIG. 3). Accordingly, ink in the ink feed hole 111 (FIG. 13) is supplied through the trenches 115 and the through-holes 160 to the main ink chambers 122 and the compensation ink chambers 122'. A plurality of bridges 150 may be formed between the through-holes 160 to connect a portion of the chamber layer 120 in which the main ink chambers 122 are formed and a portion of the chamber layer 120 in which the compensation ink chambers 122' are formed. The bridges 150 may be formed at a same height as the chamber layer 120.

Figure 10:
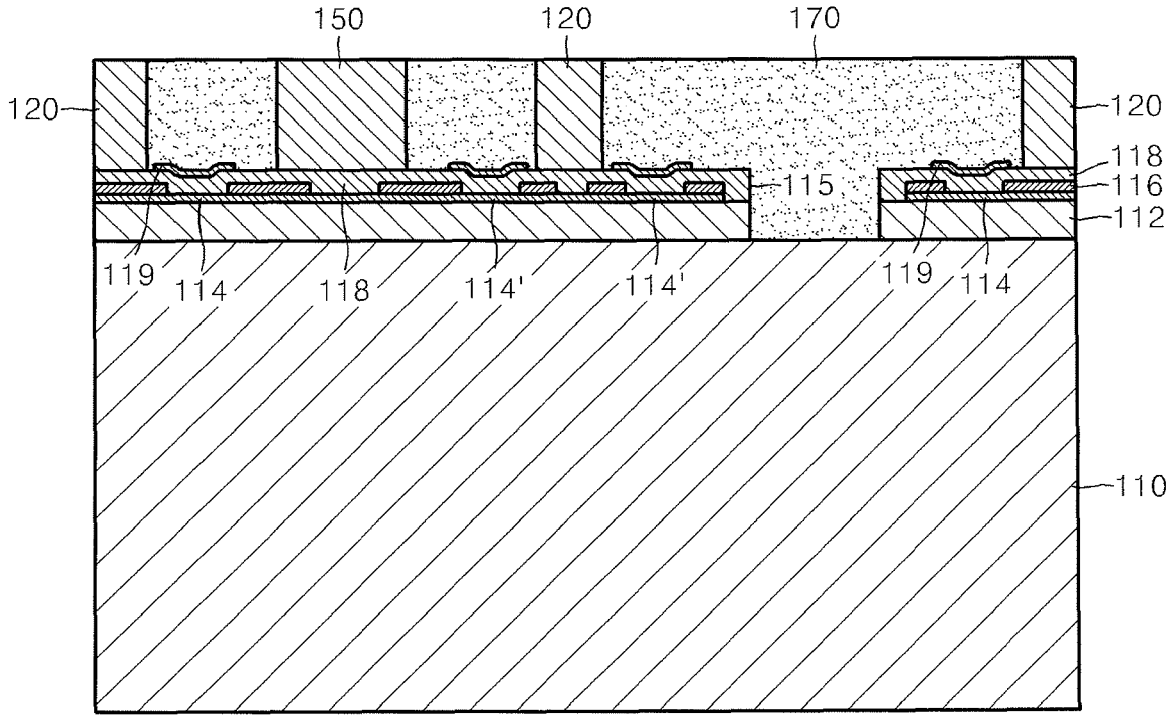

Referring to FIG. 10, a sacrificial layer 170 is filled in the main ink chambers 122, the compensation ink chambers 122', the trenches 115, and the through-holes 160. Next, a top surface of the sacrificial layer 170 may be planarized by chemical mechanical polishing (CMP).

Figure 11:
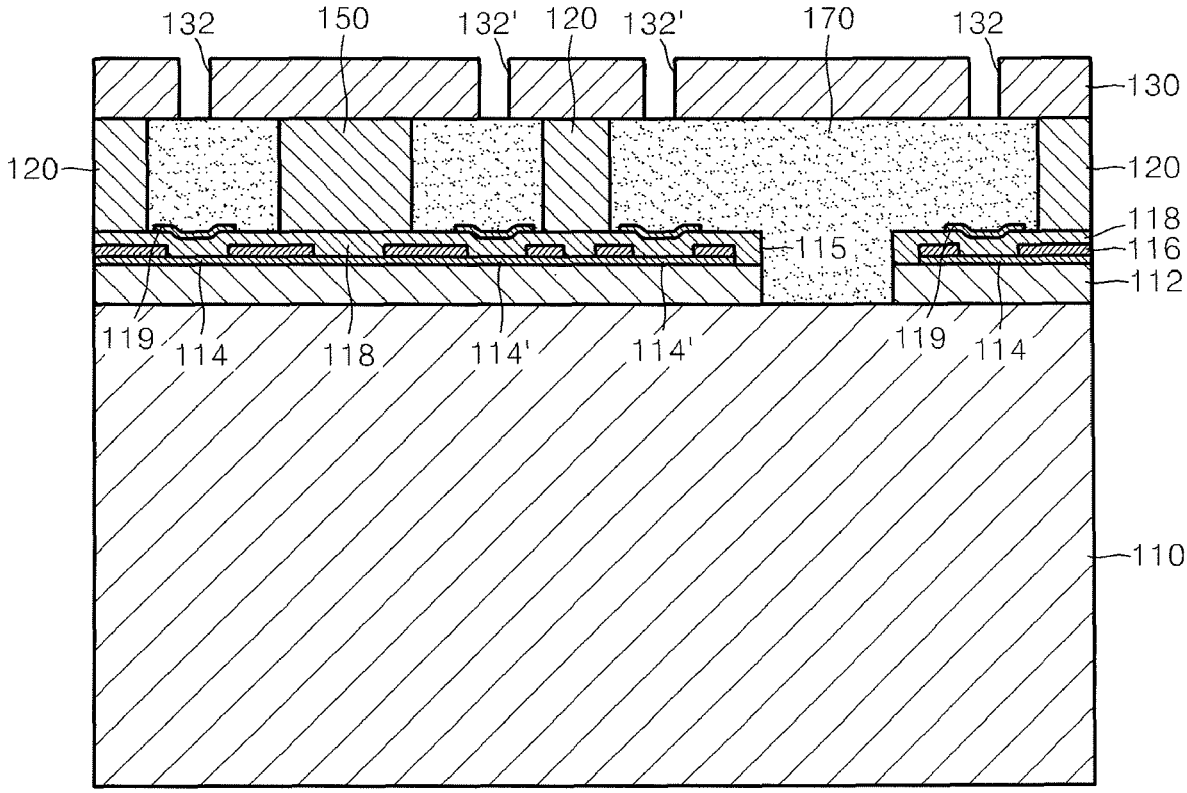

Referring to FIG. 11, a nozzle layer 130 is formed on top surfaces of the chamber layer 120 and the sacrificial layer 170. In detail, the nozzle layer 130 may be formed by depositing a nozzle material layer (not illustrated) to a thickness on the chamber layer 120 and the sacrificial layer 170, and then patterning the nozzle material layer into a predetermined shape. The nozzle layer 130 may be formed of epoxy, but the present embodiment is not limited thereto. In this process, a plurality of main nozzles 132 and a plurality of compensation nozzles 132' are formed in the nozzle layer 130. The main nozzles 132 may be formed on the main ink chambers 122, and the compensation nozzles 132' may be formed on the compensation ink chambers 122'. Accordingly, the compensation nozzles 132' may be arranged in two rows and correspond to the main nozzles 132 in a one-to-one fashion.

Figure 12:
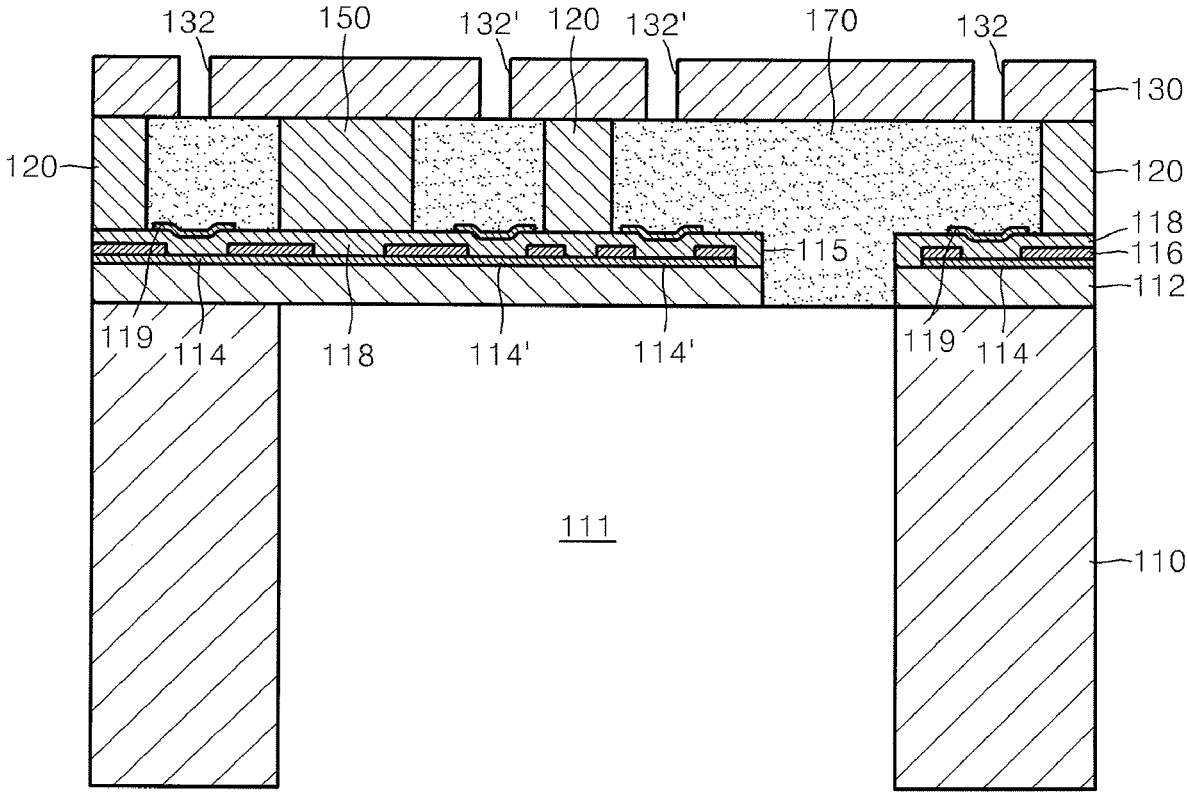
Figure 13:
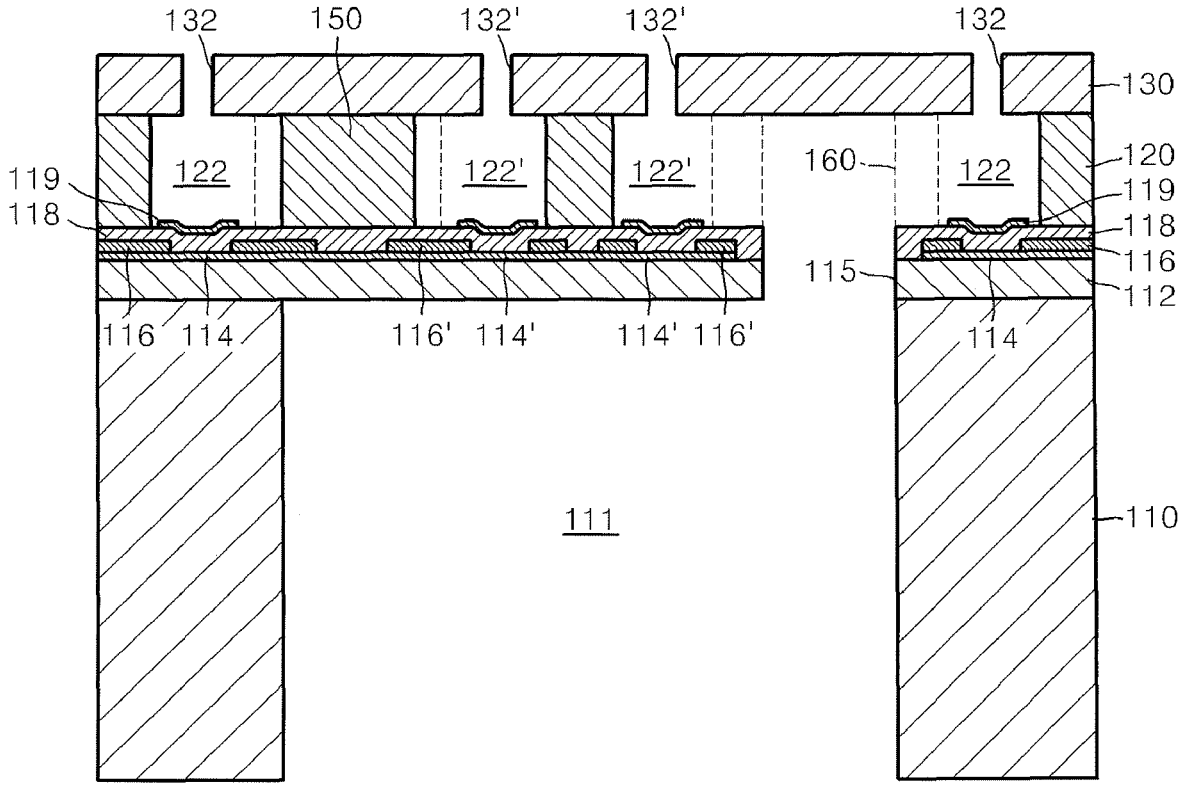

Referring to FIG. 12, the ink feed hole 111 is formed in the substrate 110 to supply ink. The ink feed hole 111 may be formed by etching a bottom surface of the substrate 110 until a bottom surface of the sacrificial layer 170 filled in the trenches 115 is exposed. Referring to FIG. 13, the sacrificial layer 170 filled in the main ink chambers 122, the compensation ink chambers 122', the trenches 115, and the through-holes 160 is removed through the ink feed hole 111, the main nozzles 132, and the compensation nozzles 132', thereby completing an inkjet printhead according to the present embodiment.

While one ink feed hole 111 is formed in the substrate 110 in FIGS. 12 and 13, the present embodiment is not limited thereto, and thus a plurality of ink feed holes 111 may be formed in the substrate 110 according to ink colors. Also, while the compensation nozzles 132' are arranged in two rows and correspond to the main nozzles 132 in a one-to-one fashion as illustrated in FIGS. 11 through 13, the present embodiment is not limited thereto, and thus the compensation nozzles 132' may be arranged in one row or three or more rows in various configurations.

As described above, according to various embodiments of the present general inventive concept, even when there is a dead nozzle, the compensation nozzles compensate for the dead nozzle, thereby preventing print quality degradation due to the dead nozzle. The inkjet printhead according to the present general inventive concept is particularly useful for a line printing type inkjet printer having a page-wide array printhead corresponding to a width of a print medium prints an image while being fixed. Accordingly, the inkjet printhead according to the present general inventive concept can achieve high speed printing and improve print quality.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An inkjet printhead, comprising:

a substrate having an ink feed hole formed to supply ink;

a chamber layer stacked on the substrate, and including a plurality of main ink chambers formed therein with the ink feed hole therebetween and a plurality of compensation ink chambers formed therein between the main ink chambers that face each other; and a nozzle layer stacked on the chamber layer, and including a plurality of main nozzles corresponding to the main ink chambers and a plurality of compensation nozzles corresponding to the compensation ink chambers, wherein each of the main nozzles formed on a side of the chamber layer is disposed between adjacent main nozzles of the main nozzles formed on an other side of the chamber layer in the longitudinal direction of the ink feed hole.

2. The inkjet printhead of claim 1, wherein the compensation nozzles are arranged in one or more rows in a direction parallel to a longitudinal direction of the ink feed hole.

3. The inkjet printhead of claim 2, wherein the compensation nozzles are arranged in two rows and correspond to the main nozzles in a one-to-one fashion.

4. The inkjet printhead of claim 1, wherein the compensation nozzles are arranged on same lines as corresponding main nozzles in a direction perpendicular to the longitudinal direction of the ink feed hole.

5. The inkjet printhead of claim 1, wherein the compensation nozzles deviate from the corresponding main nozzles in the longitudinal direction of the ink feed hole.

6. The inkjet printhead of claim 1, wherein the chamber layer has a plurality of through-holes through which ink is supplied from the ink feed hole to the main ink chambers and the compensation ink chambers.

7. The inkjet printhead of claim 6, wherein the chamber layer has bridges formed between the through-holes to connect a portion of the chamber layer in which the main chambers are formed and a portion of the chamber layer in which the compensation ink chambers are formed.

8. The inkjet printhead of claim 7, wherein the bridges are formed at a same height as the chamber layer.

9. The inkjet printhead of claim 1, wherein the main chambers are formed under the main nozzles, and the compensation ink chambers are formed under the compensation nozzles.

10. The inkjet printhead of claim 1, further comprising:

an insulating layer formed on a top surface of the substrate.

11. The inkjet printhead of claim 10, further comprising:

main heaters and compensation heaters formed on a top surface of the insulting layer to correspond to the main ink chambers and the compensation ink chambers, respectively; and main electrodes and compensation electrodes formed on top surfaces of the main heaters and the compensation heaters.

12. The inkjet printhead of claim 11, further comprising:

a passivation layer formed on the insulating layer to cover the main heaters, the compensation heaters, the main electrodes, and the compensation electrodes.

13. The inkjet printhead of claim 12, further comprising:

anti-cavitation layers formed on a top surface of the passivation layer above the main heaters and the compensation heaters.

14. An array printhead, comprising:

a plurality of inkjet printheads having a size corresponding to a width of a print medium, each inkjet printhead comprising:

a substrate having an ink feed hole formed to supply ink;

a chamber layer stacked on the substrate, and including a plurality of main ink chambers formed therein with the ink feed hole therebetween and a plurality of compensation ink chambers formed therein between the main ink chambers that face each other; and a nozzle layer stacked on the chamber layer, and including a plurality of main nozzles corresponding to the main ink chambers and a plurality of compensation nozzles corresponding to the compensation ink chambers, wherein each of the main nozzles formed on the one side of the chamber layer is disposed between adjacent main nozzles of the main nozzles formed on an other side of the chamber layer in a longitudinal direction of the ink feed hole.

15. A printing method, of an inkjet printhead, the printing method comprising:

ejecting ink from leading main nozzles formed on one side of a chamber layer in a print direction of an inkjet printhead;

ejecting ink from compensation nozzles; and ejecting ink from trailing main nozzles formed on an other side of the chamber layer in the print direction, wherein each of the main nozzles formed on the one side of the chamber layer is disposed between adjacent main nozzles of the main nozzles formed on an other side of the chamber layer in a longitudinal direction of the ink feed hole.

16. The printing method of claim 15, wherein the compensation nozzles are arranged in two rows and correspond to the main nozzles in a one-to-one fashion.

17. The printing method of claim 16, wherein the ejecting of the ink from the compensation nozzles comprises:

ejecting ink from the leading compensation nozzles in the print direction; and ejecting ink from the trailing compensation nozzles in the print direction.

18. The printing method of claim 15, wherein the compensation nozzles are arranged on same lines as corresponding main nozzles in a direction perpendicular to the longitudinal direction of the ink feed hole.

19. The printing method of claim 15, wherein the compensation nozzles deviate from the corresponding main nozzles in the longitudinal direction of the ink feed hole.

* * * * *